US007738001B2

(12) United States Patent
Routley et al.

(10) Patent No.: US 7,738,001 B2
(45) Date of Patent: Jun. 15, 2010

(54) PWM DRIVER FOR A PASSIVE MATRIX DISPLAY AND CORRESPONDING METHOD

(75) Inventors: Paul R. Routley, Cambridge (GB); Euan C. Smith, Cambridge (GB)

(73) Assignee: Cambridge Display Technology Limited, Cambridgeshire (GB)

( * ) Notice: Subject to any disclaimer, the term of this patent is extended or adjusted under 35 U.S.C. 154(b) by 891 days.

(21) Appl. No.: 10/555,335

(22) PCT Filed: Mar. 30, 2004

(86) PCT No.: PCT/GB2004/001371

§ 371 (c)(1),
(2), (4) Date: Nov. 6, 2006

(87) PCT Pub. No.: WO2004/097785

PCT Pub. Date: Nov. 11, 2004

(65) Prior Publication Data

US 2007/0046611 A1 Mar. 1, 2007

(30) Foreign Application Priority Data

Apr. 29, 2003 (GB) ..... 0309803.5

(51) Int. Cl.
*G09G 5/10* (2006.01)

(52) U.S. Cl. ..... 345/691; 345/68; 345/76; 345/77; 345/80; 345/206; 345/204; 327/108

(58) Field of Classification Search ..... 345/167, 345/68, 76, 77, 98, 204; 327/108; 348/571
See application file for complete search history.

(56) References Cited

U.S. PATENT DOCUMENTS

| | | | | |
|---|---|---|---|---|
| 5,095,304 | A * | 3/1992 | Young | 345/92 |
| 5,648,793 | A * | 7/1997 | Chen | 345/96 |
| 5,689,278 | A | 11/1997 | Barker et al. | 345/74 |
| 6,169,372 | B1 | 1/2001 | Kobayashi et al. | 315/169.3 |
| 6,359,605 | B1 * | 3/2002 | Knapp et al. | 345/76 |
| 6,844,896 | B2 * | 1/2005 | Henderson et al. | 348/241 |
| 2002/0167474 | A1 | 11/2002 | Everitt | 345/82 |
| 2003/0222893 | A1 * | 12/2003 | Koester et al. | 345/691 |
| 2004/0263045 | A1 * | 12/2004 | Smith et al. | 313/373 |

FOREIGN PATENT DOCUMENTS

JP 11-242465 9/1999

* cited by examiner

*Primary Examiner*—Bipin Shalwala
*Assistant Examiner*—Vince E Kovalick
(74) *Attorney, Agent, or Firm*—Marshall, Gerstein & Borun LLP

(57) ABSTRACT

This invention generally relates to apparatus and methods for driving passive, electro-optic displays with greater efficiency. The invention is particularly suitable for driving passive matrix organic light emitting diode displays.

17 Claims, 9 Drawing Sheets

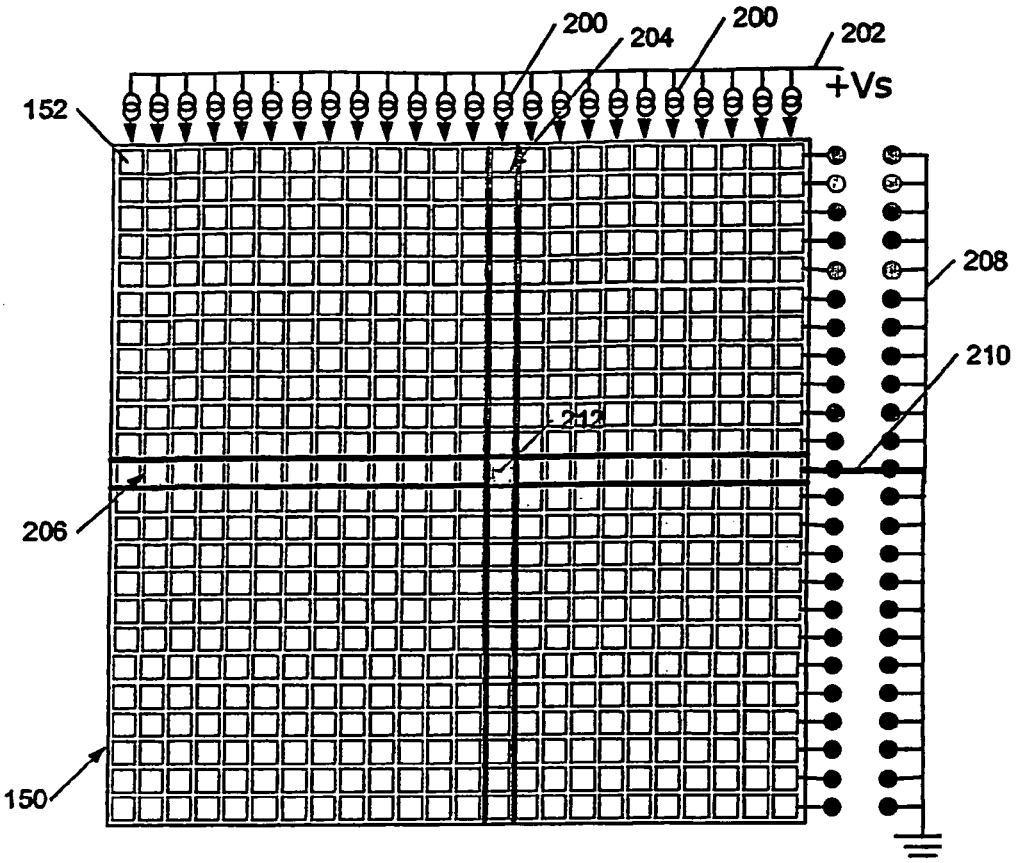
Figure 2a
Figure 2b
Figure 2c
Figure 2d
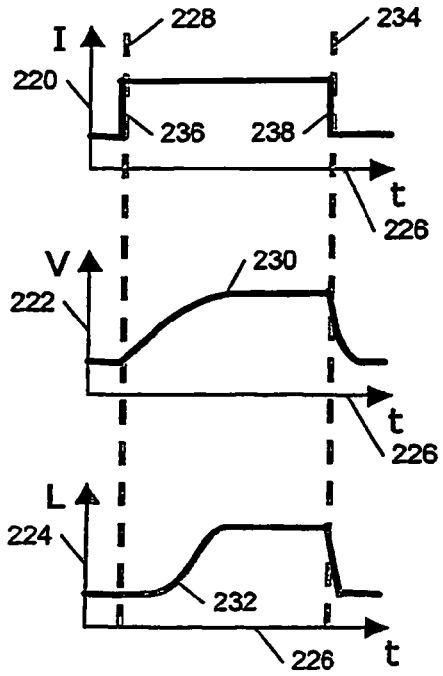

300

700

750

PWM DRIVER FOR A PASSIVE MATRIX DISPLAY AND CORRESPONDING METHOD

BACKGROUND OF THE INVENTION

1. Field of the Invention

This invention generally relates to methods and apparatus for driving passive, electro-optic displays with greater efficiency. The invention is particularly suitable for driving passive matrix organic light emitting diode displays.

2. Related Technology

Organic light emitting diodes (OLEDs) comprise a particularly advantageous form of electro-optic display. They are bright, colourful, fast-switching, provide a wide viewing angle and are easy and cheap to fabricate on a variety of substrates. Organic LEDs may be fabricated using either polymers or small molecules in a range of colours (or in multi-coloured displays), depending upon the materials used Examples of polymer-based organic LEDs are described in WO 90/13148, WO 95/06400 and WO 99/48160; examples of so called small molecule based devices are described in U.S. Pat. No. 4,539,507.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise, for example, PEDOT:PSS (polystyrene-sulphonate-doped polyethylene-dioxythiophene). Cathode layer 110 typically comprises a low work function metal such as calcium and may include an additional layer immediately adjacent electroluminescent layer 108, such as a layer of aluminium, for improved electron energy level matching. Contact wires 114 and 116 to the anode the cathode respectively provide a connection to a power source 118. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example by keeping the thickness of cathode layer 110 less than around 50-100 nm so that the cathode is substantially transparent.

Organic LEDs may be deposited on a substrate in a matrix of pixels to form a single or multi-colour pixelated display. A multicoloured display may be constructed using groups of red, green, and blue emitting pixels. In such displays the individual elements are generally addressed by activating row (or column) lines to select the pixels, and rows (or columns) of pixels are written to, to create a display. Either a passive matrix or an active matrix configuration may be employed. Broadly speaking in a passive matrix display a pixel driver such as a constant current driver is multiplexed onto a pixel whereas in an active matrix display a dedicated driver is provided for each pixel. Thus so-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

FIG. 1*b* shows a cross section through a passive matrix OLED display 150 in which like elements to those of FIG. 1*a* are indicated by like reference numerals. In the passive matrix display 150 the electroluminescent layer 108 comprises a plurality of pixels 152 and the cathode layer 110 comprises a plurality of mutually electrically insulated conductive lines 154, running into the page in FIG. 1*b*, each with an associated contact 156. Likewise the ITO anode layer 104 also comprises a plurality of anode lines 158, of which only one is shown in FIG. 1*b*, running at right angles to the cathode lines. Contacts (not shown in FIG. 1*b*) are also provided for each anode line. An electroluminescent pixel 152 at the intersection of a cathode line and anode line may be addressed by applying a voltage between the relevant anode and cathode lines.

Referring now to FIG. 2*a*, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Alternatively a row may be selected and all the columns written in parallel, that is a row selected and a current driven onto each of the column lines simultaneously, to simultaneously illuminate each pixel in a row at its desired brightness. Although this latter arrangement requires more column drive circuitry it is preferred because it allows a more rapid refresh of each pixel. In a further alternative arrangement each pixel in a column may be addressed in turn before the next column is addressed, although this is not preferred because of the effect, inter alia, of row resistance. It will be appreciated that in the arrangement of FIG. 2*a* the functions of the column driver circuitry and row driver circuitry may be exchanged.

The skilled person will understand that where the term "brightness" is employed, when it is applied to an OLED it should generally be taken to mean luminance.

It is usual to provide a current-controlled rather than a voltage-controlled drive to an OLED because the brightness or more precisely, luminance, of an OLED is determined by the current flowing through it, this determining the number of photons it outputs. Thus the brightness-current curve of an OLED is broadly linear whereas the brightness-voltage curve is strongly non-linear. For this reason, in a voltage-controlled configuration the brightness can vary across the area of a display and with time, temperature, and age, making it difficult to predict how bright a pixel will appear when driven by a given voltage. In a colour display the accuracy of colour representations may also be affected.

FIGS. 2*b* to 2*d* illustrate, respectively, the current drive 220 applied to a pixel, the voltage 222 across the pixel, and the light output 224 from the pixel over time 226 as the pixel is addressed. The row containing the pixel is addressed and at the time indicated by dashed line 228 the current is driven onto the column line for the pixel. The column line (and pixel) has an associated capacitance and thus the voltage gradually rises to a maximum 230. The pixel does not begin to emit light until a point 232 is reached where the voltage across the pixel is greater than the OLED diode voltage drop. Similarly when the drive current is turned off at time 234 the voltage and light output gradually decay as the column capacitance discharges. Where the pixels in a row are all written simultaneously, that is where the columns are driven in parallel, the time interval between times 228 and 234 corresponds to a line scan period.

It is desirable for many applications to be able to provide a greyscale-type display, that is one in which the apparent brightness of individual pixels may be varied rather than simply set either on or off. Here "greyscale" refers to such a variable brightness display, whether a pixel is white or coloured.

The conventional method of varying pixel brightness is to vary pixel on-time using Pulse Width Modulation (PWM). In the context of FIG. 2*b* above the apparent pixel brightness may be varied by varying the percentage of the interval between times 228 and 234 for which drive current is applied. Normally in a PWM scheme a pixel is either full on or completely off but the apparent brightness of a pixel varies because of time integration within the observer's eye.

Pulse Width Modulation schemes provide a good linear brightness response but to overcome effects related to the delayed pixel turn-on they generally employ a pre-charge current pulse (not shown in FIG. 2*b*) on the leading edge 236 of the driving current waveform, and sometimes a discharge pulse on the trailing edge 238 of the waveform. This can improve the greyscale resolution but at the expense of increased power consumption. As a result, charging (and discharging) the column capacitance can account for roughly half the total power consumption in displays incorporating this type of brightness control. Other significant factors which the applicant has identified as contributing to the power consumption of a display plus driver combination include dissipation within the OLED itself (a function of OLED efficiency), resistive losses in the row and column lines and the effects of limited current driver compliance, as explained in more detail later.

FIG. 3 shows a schematic diagram 300 of a generic driver circuit for a passive matrix OLED display. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-diver 316 are typically both under the control of a processor 318. A power supply 320 provides power to the circuitry and, in particular, to y-driver 314. It will be appreciated that which electrodes are labelled as "row" electrodes and which are labelled as "column" electrodes is arbitrary.

FIG. 4 shows, schematically, a current driver 402 for one column line of a passive matrix OLED display, such as the display 302 of FIG. 3. Typically a plurality of such current drivers are provided in a column driver integrated circuit, such as Y-driver 314 of FIG. 3, for driving a plurality of passive matrix display column electrodes.

A particularly advantageous form of current driver 402 is described in the applicant's co-pending British patent application no. 0126120.5 entitled "Display Driver Circuits". The current driver 402 of FIG. 4 outlines the main features of this circuit and comprises a current driver block 406 incorporating a bipolar transistor 416 which has an emitter terminal substantially directly connected to a power supply line 404 at supply voltage $V_s$. (This does not necessarily require that the emitter terminal should be connected to a power supply line or terminal for the driver by the most direct route but rather that there should preferably be no intervening components, apart from the intrinsic resistance of tracks or connections within the driver circuitry between the emitter and a power supply rail). A column drive output 408 provides a current drive to OLED 412, which also has a ground connection 414, normally via a row driver MOS switch (not shown in FIG. 4). A current control input 410 is provided to current driver block 406 and, for the purposes of illustration, this is shown connected to the base of transistor 416 although in practice a current mirror arrangement is preferred. The signal on current control line 410 may comprise either a voltage or a current signal.

The arrangement of FIG. 4 is useful because the (optionally variable) current generator has a high compliance, that is a low value of $V_s$-$V_o$, where $V_s$ is the supply voltage and $V_o$ is substantially the maximum output voltage of the current source. The lower the current driver compliance (i.e. the greater $V_s$-$V_o$), the greater the power losses due to limited driver compliance. Further compliance-related techniques for reducing power consumption are described in the Applicant's UK Patent Application number 0213989.7 filed on 18 Jun. 2002.

Specific examples of OLED display drivers are described in U.S. Pat. No. 6,014,119, U.S. Pat. No. 6,201,520, U.S. Pat. No. 6,332,661, EP 1,079,361A and EP 1,091,339A; OLED display driver integrated circuits are also sold by Clare Micronix of Clare, Inc., Beverly, Mass., USA. The Clare Micronix drivers provide a current controlled drive and achieve greyscaling using a conventional PWM approach; U.S. Pat. No. 6,014,119 describes a driver circuit in which pulse width modulation is used to control brightness; U.S. Pat. No. 6,201,520 describes driver circuitry in which each column driver has a constant current generator to provide digital (on/off) pixel control; U.S. Pat. No. 6,332,661 describes pixel driver circuitry in which a reference current generator sets the current output of a constant current driver for a plurality of columns; and EP 1,079,361A and EP 1,091,339A both describe similar drivers for organic electroluminescent display elements in which a voltage drive rather than a current drive is employed.

Prior art techniques for reducing the power consumption of liquid crystal displays (LCDs) are described in U.S. Pat. No. 6,323,849 and EP 0 811 866A. U.S. Pat. No. 6,323,849 describes an LCD display with a partial display mode in which a control circuit controls display drivers to turn off a portion of the display which does not show useful information. When the LCD module is in a partial display mode the line frequency may also be reduced whilst maintaining the same frame refresh rate, allowing a lower voltage to be used to produce the same amount of charge. However, a user must predetermine which portion of the display is to be used, which will typically require additional control functions and software in the device for which the display is provided. EP 0 811 866A describes a similar technique, albeit with a more flexible driving arrangement. Another technique is described in the Applicant's UK patent application number 0209502.4.

U.S. Pat. No. 4,823,121 describes an electroluminescent (EL) panel driving system which detects the absence of a HIGH level signal representing a spot illumination of the EL panel in the image data of a line and, in response to this, prevents four circuits (a pre-charge circuit, a pullup circuit, a write-in circuit and a source circuit) from being activated.

However the power savings provided by this technique are specific to the drive arrangement for the type of electroluminescent panel described and are not readily generalisable. Furthermore the savings are relatively modest.

It is generally desirable to reduce the power consumption of the display plus driver combination, particularly whilst retaining the ability to provide a variable brightness or "greyscale" display.

SUMMARY OF THE INVENTION

According to a first aspect of the present invention there is therefore provided a driver for a passive electro-optic display, the display having a plurality of display elements addressed by a common first electrode and a plurality of second electrodes, the display driver being configured to successively select each of said second electrodes in turn and to provide a variable pulse length drive to said first electrode during a period when a said second electrode is selected to provide a corresponding variable (brightness) level (display) from each of said display elements, the driver comprising a data input to receive drive level data for each of said display elements; an electrode selection input to receive a second electrode selection signal for determining said period when a said second electrode is selected to address a corresponding display element; a drive output for driving said first electrode with a pulse having a length determined by said drive level data; and a pulse generator coupled to said data input, to said electrode selection input and to said drive output, said pulse generator being configured to generate a pulsed drive signal for said drive output responsive to said drive level data and to said second electrode selection signal, said pulsed drive signal having on states, and off states and transitions therebetween; and wherein said pulsed drive signal for driving successively selected second electrodes remains in one of a said on state and a said off state during selection of a successive second electrode and has a transition during said period when a said second electrode is selected.

The driver may comprise either a conventional dedicated circuit or a microcontroller under software control. As the drive signal provided by the pulse generator remains in either its on state or its off state during selection of a successive second electrode there is no need to charge or discharge the first electrode, in embodiments a column line, at this time. This contrasts with a conventional pulse width modulation brightness control scheme in which a new "on" pulse begins when each successive second electrode, typically a row electrode, is selected. Thus in embodiments, by comparison with a conventional scheme, the above described circuit approximately halves the number of transitions on the first electrode or column line, thus approximately halving the associated capacitative losses. In embodiments this provides a substantial power saving since these losses may account for up to half the total power consumption of a display and driver combination.

In one embodiment the pulse generator comprises a counter configured to count either up or down in response to a clock signal input. A comparator compares an output of the counter with the drive level data for an address display element, switching the display element on or off when the counter reaches a value determined by the drive level data. In this way the duration of the on (or off) state portion of a drive signal pulse may be varied according to the desired brightness of the address display element.

In preferred embodiments the pulse generator further comprises an inverter to invert either the count or the drive level data for alternately addressed second electrodes, typically alternate ones of successively addressed rows, to thereby in effect invert a PWM pulse in the time domain for alternate second electrodes. Thus, for example, a first second electrode might be driven by a pulse width modulated drive signal with an initial off period followed by an on period, and the next second electrode driven by a pulse width modulated drive signal comprising an on period followed by an off period. The inverter preferably comprise(s) a simple or 1's complement inversion but may comprise a 2's complement inversion. To invert alternate second electrodes, the inverter may be coupled to the electrode selection input via a divide-by-2 circuit.

In a preferred embodiment the counter also includes a gate so that if the drive level data corresponds to a maximum (or minimum) value of said count a final transition of the pulse is suppressed. In a pulse width modulation (PWM) scheme a fully off (or on, depending upon the sign of the waveform), display element may be provided with a drive waveform which has a long off (on) state and a very brief final on (off) state. However it is desirable to remove this brief final on (off) state as his cues an unnecessary additional transition—with a fully off (on) display element there is no need for the pulse waveform to make such a final transition.

In preferred embodiments the display comprises a passive matrix electroluminescent display, and in particular an OLED display, since there are special problems associated with device capacitance in such displays. Thus the first electrode may comprise a column electrode of the matrix and the second electrodes row electrodes of the matrix (although it will be recognised that labelling of one set of electrodes as column electrodes and a second set of electrodes as row electrodes is arbitrary). Generally in such a display there is a plurality of said first, column electrodes.

The first electrodes of such a display are preferably connected to the OLED anodes since it is then the second, row electrodes which are connected to the cathodes, a said second electrode carrying current from each of the illuminated display elements in a row simultaneously. In an OLED structure such as that shown in FIGS. 1*a* and 1*b* it is easier to fabricate a low resistance cathode line than a low resistance anode connection.

In a preferred embodiment of the above described circuit, the driver output provides a substantially constant current drive to the display (at least during the on state of the PWM waveform). For example, a constant current source may be provided external to the circuit and then switched through to the display in synchronism with the pulsed drive signal for example, by means of a bipolar transistor or FET (field effect transistor). A high compliance arrangement such as described above with reference to FIG. 4 may be employed.

In a related aspect the invention provides a display driver for a passive matrix organo-electroluminescent display, the display having a plurality of row and column electrodes for addressing elements of the display, the driver being configured to successively select row electrodes of said display and to drive a said column electrode with successive pulse width modulated drive signals to drive a display element in each selected row to a brightness determined by a said drive signal; and wherein said display driver is further configured to provide pulse width modulated drive signals which are inverted in the time domain for alternate ones of said successively selected rows.

As previously described, in embodiments the PWM signals for pairs of successively selected rows are time-inverted with respect to one another.

The invention further provides a display driver for a passive matrix organo-electroluminescent display, the display having a plurality of row and column electrodes for addressing elements of the display, the driver being configured to successively select row electrodes of said display and to drive a said column electrode with successive pulse width modulated drive signals to drive a display element in each selected row to a brightness determined by a said drive signal; and wherein a said pulse width modulated drive signal has an on portion and an off portion, and wherein said driver is further configured to drive said column electrode for successive pairs of rows such that an off portion of a said pulse width modulated drive signal for a it selected row of a said pair followed by an, on portion of said pulse width modulated drive signal for said first selected row is followed by an on portion of said pulse width modulated drive signal for a second selected row of said pair followed by an off portion of said pulse width modulated drive signal for said second selected row of said pair.

The invention also provides a method of driving a passive electro-optic display using a pulse width modulated drive signal, the display having at least one first electrode and a plurality of second electrodes for driving elements of the display, a selected display element being driven by selecting one of said second electrodes and applying said pulse width modulated drive signal across said first electrode and said selected second electrode, the method comprising: selecting a first of said second electrodes to select a first said display element; driving a first pulse width modulated signal across said first electrode and said first selected second electrode in accordance with a desired brightness of said first selected display element; selecting a second of said second electrodes to select a second of said display elements; and driving a second pulse width modulated signal across said first electrode and said second selected second electrode in accordance with a desired brightness of said second selected display element; and wherein said first and second pulse width modulated signals each comprise a first portion followed by a second portion, one of said first and second portions comprising a on state of said signal the other of said portions comprising an off state of said signal; and wherein said second portion of said first pulse width modulated signal and said first portion of said second pulse width modulated signal have the substantially same said state.

Embodiments of this method provide a reduced power consumption display driving procedure for the reasons previously described.

The invention further provides a method of driving a passive electro-optic display using a pulse width modulated drive signal, the display having at least one first electrode and a plurality of second electrodes for driving elements of the display, a selected display element being driven by selecting one of said second electrodes and applying said pulse width modulated drive signal across said first electrode and said selected second electrode, the method comprising: selecting a first of said second electrodes to select a first said display element; driving a first pulse width modulated signal across said first electrode and said first selected second electrode in accordance with a desired brightness of said first selected display element; selecting a second of said second electrodes to select a second of said display elements; and driving a second pulse width modulated signal across said first electrode and said second selected second electrode in accordance with a desired brightness of said second selected display element; and wherein said second pulse width modulated signal is time reversed with respect to said first pulse modulated signal.

The skilled person will appreciate that the first and second pulse width modulated signals may have different durations of their on and off states but they are time reversed in the sense that the order of their on state and off state is exchanged.

The invention further provides a display driver controller for controlling a display driver for a passive electro-optic display using a pulse width modulated drive signal, the display having at least one first electrode and a plurality of second electrodes for driving elements of the display, a selected display element being driven by selecting one of said second electrodes and applying said pulse width modulated drive signal across said first electrode and said selected second electrode, the display driver controller comprising: means for selecting a first of said second electrodes to select a first said display elements; means for driving a first pulse width modulated signal across said first electrode and said first selected second electrode in accordance with a desired brightness of said first selected display element; means for selecting a second of said second electrodes to select a second of said display elements; and means for driving a second pulse width modulated signal across said first electrode and said second electrode in accordance with a desired brightness of said second selected display element; and wherein said first and second pulse width modulated signals each comprise a first portion followed by a second portion, one of said first and second portions comprising a on state of said signal the other of said portions comprising an off state of said signal; and wherein said second portion of said first pulse width modulated signal and said first portion of said second pulse width modulated signal have the substantially same said state.

The means for performing the above mentioned functions may either comprise dedicated hardware or a processor operating under control of processor control code (or a combination of the two). Thus the invention further provides processor control code to implement the above described methods. Such processor control code may comprise code in any conventional programming language, or assembler or machine code or microcode, or code for a hardware description language such as Varilog™, VHDL (Very High Speed Integrated Circuit Hardware Description Language) or SystemC. Such code may be provided on a data carrier such as a disk, CD- or DVD-ROM, ROM, or on programmed memory such as read-only memory (Firmware), or on a data carrier such as an optical or electrical signal carrier.

BRIEF DESCRIPTION OF THE DRAWINGS

These and other aspects of the present invention will now be further described, by way of example only, with reference to the accompanying figures in which:

FIGS. 2*a* to 2*d* show, respectively, a conceptual driver arrangement for a passive matrix OLED display, a graph of current drive against time for a display pixel, a graph of pixel voltage against time, and a graph of pixel light output against time;

DETAILED DESCRIPTION

Figure 1A:
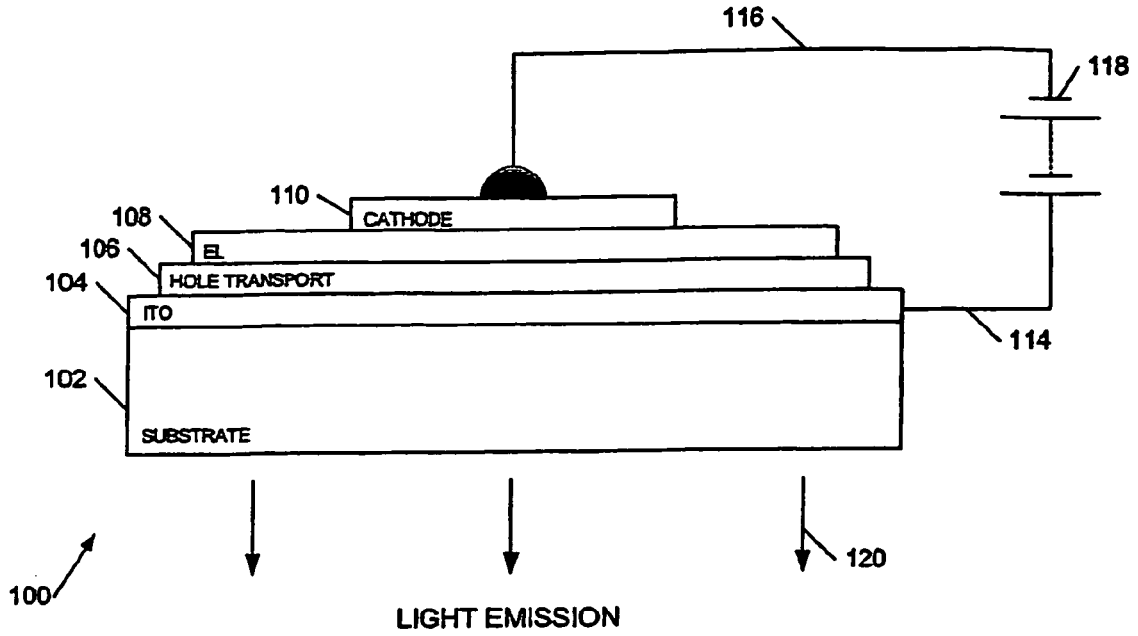
Figure 1a (PRIOR ART)
FIGS. 1*a* and 1*b* show cross sections through, respectively, an organic light emitting diode and a passive matrix OLED display.
Figure 1B:
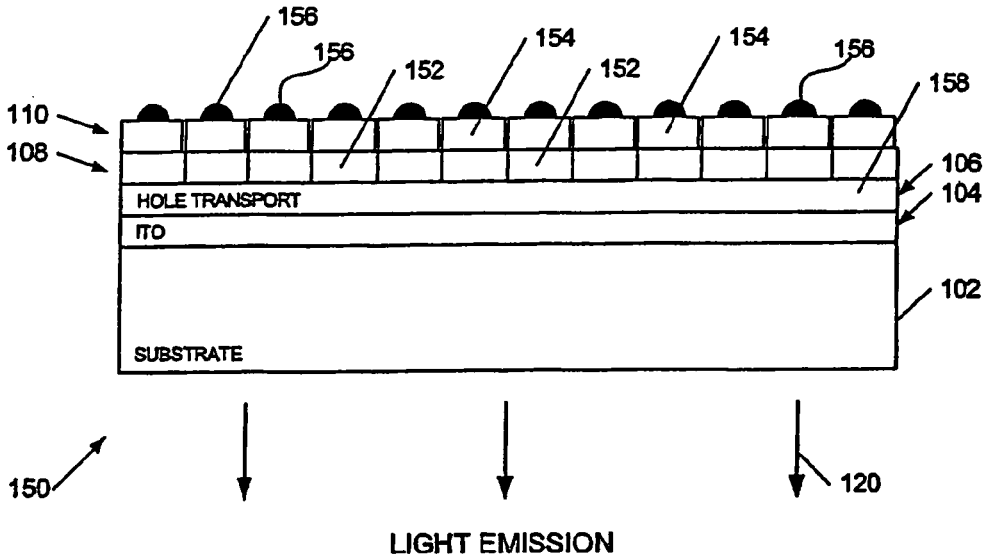
Figure 1b (PRIOR ART)
Figure 3:
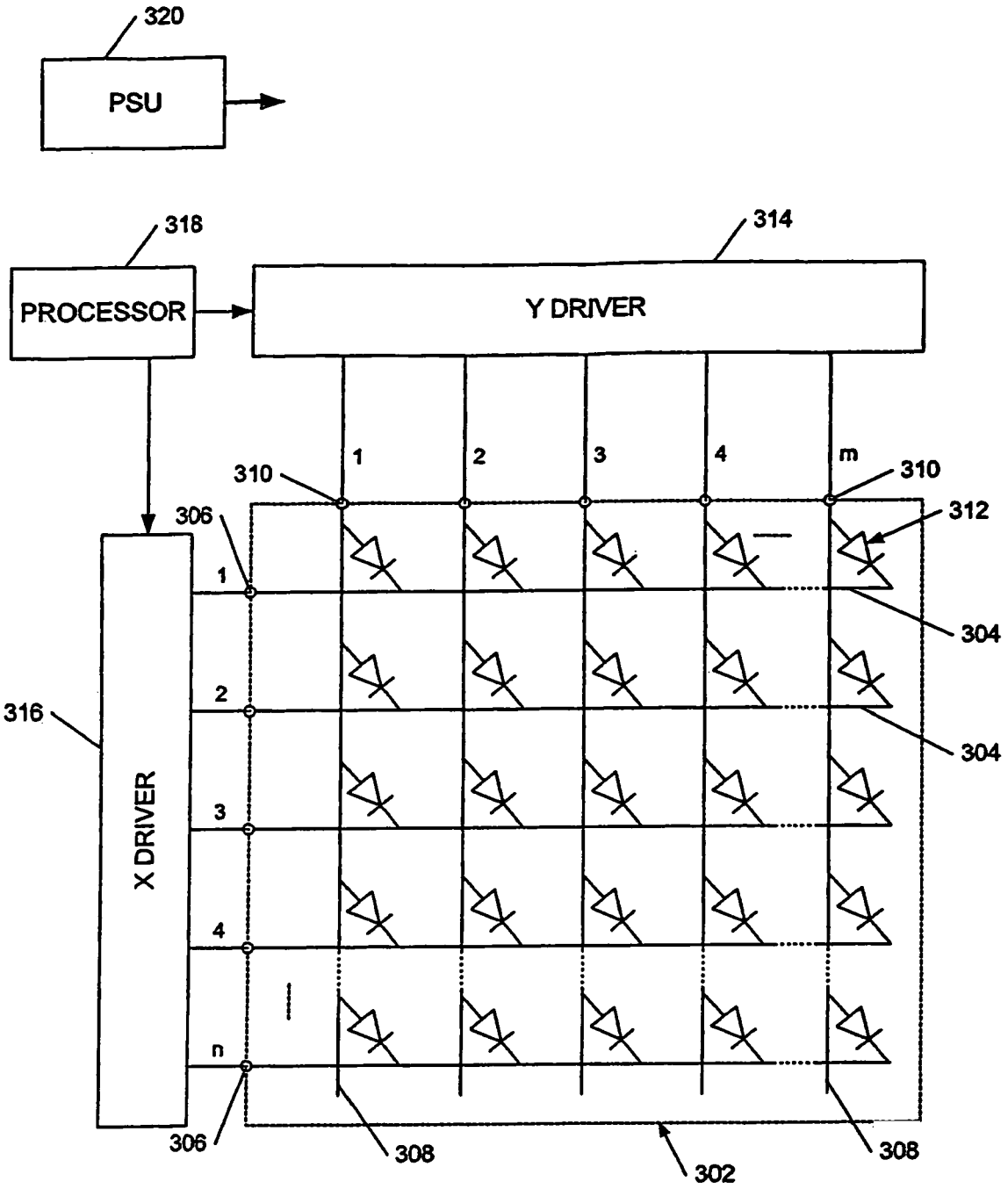
Figure 3 (PRIOR ART)
FIG. 3 shows a schematic diagram of a generic driver circuit for a passive matrix OLED display according to the prior art.
Figure 4:
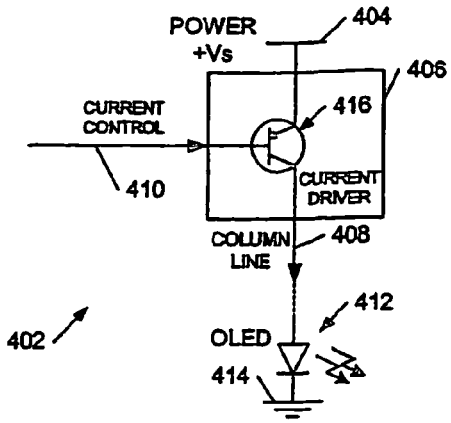
FIG. 4 shows a current driver for a column of a passive matrix OLED display.
Figure 5A:
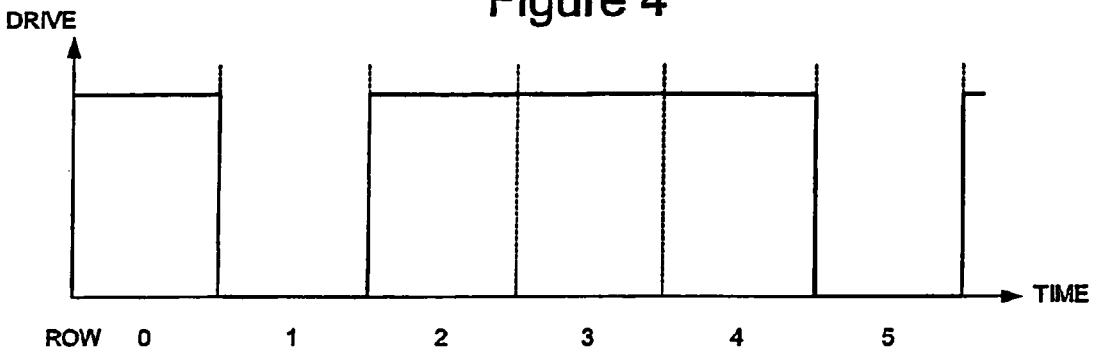
FIGS. 5*a* to 5*c* show a column drive waveform for a passive matrix OLED display without greyscale, a conventional pulse width modulated column drive waveform for a greyscale display, and a modified pulse width modulated column drive waveform for a greyscale display embodying an aspect of the present invention respectively.

Referring to FIG. 5*a*, this shows a column drive waveform for a passive matrix OLED display such as that shown in FIGS. 2*a* and 3. A substantially constant current drive is employed, the drive current being shown on the Y-axis and time on the X-axis. The time axis is subdivided into a plurality of intervals, one for each addressed row beginning at row 0. It can be seen that in FIG. 5*a* the current drive is either on for a complete row interval or off for a complete row interval and thus an addressed pixel is either fully on or fully off. Since in a passive matrix display all the columns can be drive simultaneously, for a fixed frame interval the time for which an individual row is addressed is inversely proportional to the number of rows. For example, a typical frame ratio is 60 Hz which, for a 100 line (row) display, gives a line (row) frequency of 6 KHz, that is a 166 μs row address period. For a fixed row pitch the column capacitance is approximately linearly dependent upon the number of rows and thus the capacitative losses scale approximately with the square of the number of rows.

Figure 5B:
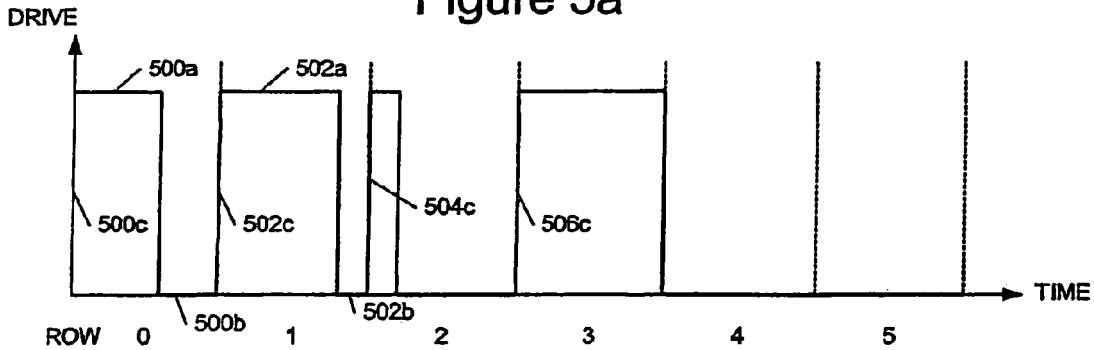

Referring now to FIG. 5*b*, this has the same axis as FIG. 5*a* but shows a pulse width modulated (PWM) drive waveform for producing a greyscale-type display, that is to permit the brightness of individually addressed pixels to be varied. Thus, in FIG. 5*b* each row interval comprises a first period during which a current drive is applied and a second period during which the current drive is zero. For the first row, row 0 the drive is on during period 500*a* and off during period 500*b*, and since these periods are approximately equal the row 0 pixel in this column will have approximately half its full brightness. For row 1 the on period 502*a* is substantially longer than the off period 502*b* and thus the row 1 pixel in this column will have close to its full brightness. It can be seen that the row 3 pixel is fully on whilst the row 4 and row 5 pixels are fully off.

Continuing to refer to FIG. 5*b* it can be seen that with this PWM drive waveform there is a transition from an off state to an on state as each successive row is addressed (transitions 500*c*, 502*c*, 504*c*, and 506*c* in the figure). Each of these off-on transitions charges the entire column capacitance, and thus requires significant power.

Figure 5C:
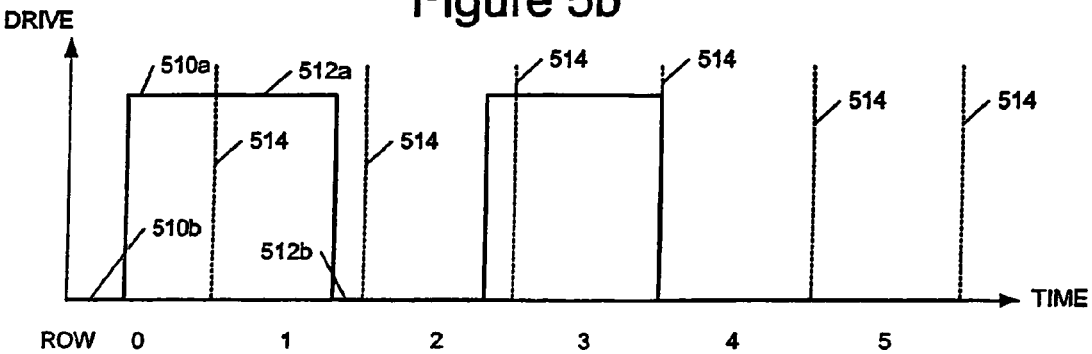

Referring now to FIG. 5*c* this shows a modified PWM waveform according to an embodiment of the present invention. In this waveform, depending upon the number of partially illuminated pixels in the display, the number of transitions is approximately halved. In FIG. 5*c* the pixel brightnesses for rows 1 to 5 are the same as those of FIG. 5*b* but the PWM waveforms of alternate rows have been modified, more particularly inverted in time. The effect of this is that for transitions from one row to the next the column either remains charged or remains uncharged, thus approximately halving the number of transitions and hence the capacitative losses.

In more detail, on the portion 510*a* of FIG. 5*c* row 0 corresponds to on portion 500*a* of FIG. 5*b* row 0, and off portion 510*b* of FIG. 5*c* row 0 corresponds to off portion 500*b* of FIG. 5*b* row 0. Thus over the interval during which row 0 is selected the waveform of FIG. 5*b* has been inverted in time. The waveform for row 1 however is not time-inverted, and thus portions 512*a, b* occur in the same order as portions 502*a, b* of the row 1 waveform of 5*b*. The row 2 waveform of FIG. 5*c* is again inverted in time with respect to that of FIG. 5*b*, but the row 3 waveform is unchanged Although the row 4 waveform of FIG. 5*c* is inverted in time because this waveform corresponds to a fully off pixel there is no change from the non-inverted version; the same applies to a fully on pixel. Thus it can be seen that in FIG. 5*c* the PWM waveforms of alternate lines are inverted in time over the row select interval. The effect of this is that at the point in time when each successive row is selected, as indicated by dashed lines 514, the drive on the column line remains either on or off, thus reducing by approximately half the number of times the column line needs to be either charged or discharged.

Figure 6:
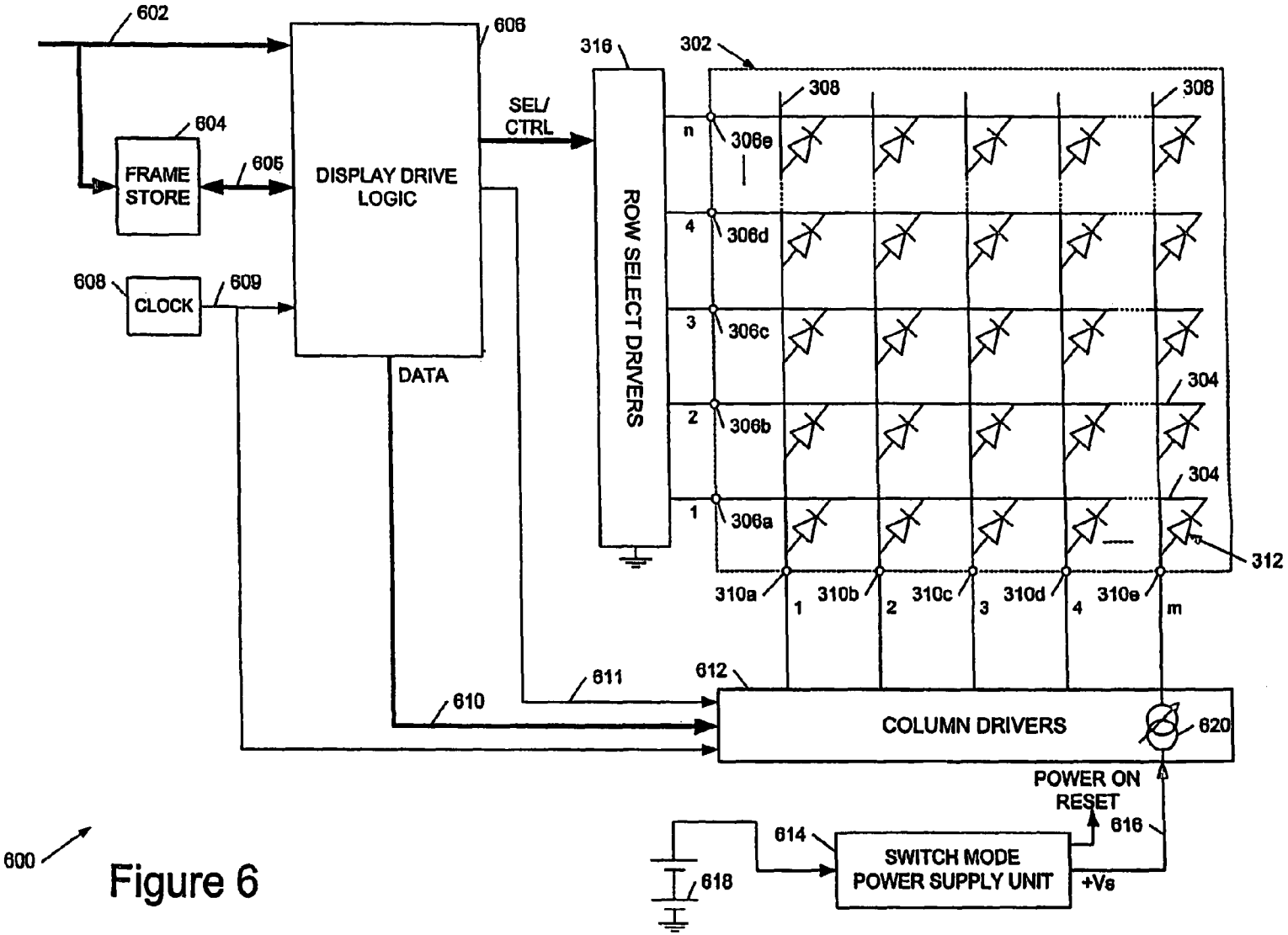
FIG. 6 shows a passive matrix OLED display and drive circuit.

Referring now to FIG. 6, this shows a block diagram of one example of a passive matrix OLED display drive circuit 600 driving a display 302 similar to that shown in FIG. 3 (in which like features are indicated by like reference numbers).

In FIG. 6 data for display is provided on a bus 602 to display drive logic 606 and optionally to a frame store 604. The display drive logic 606 controls a plurality of row select circuits 316, for example comprising FET switches, and also provides data on bus 610 to column drivers 612. A clock 608 is provided for the display drive logic and column drivers circuitry 612. The column drivers in this example include a substantially constant current generator (source or sink) illusively shown by constant current generator 620; in other embodiments the current generator may be external to the column drivers. One such constant current generator may be provided for each column or a single such generator may be shared between a plurality of columns. Display drive logic 606 also provides a row select strobe line 611 to the column drivers 612, a rising edge of this strobe signal indicating that a new row line has been selected.

Power is supplied by a battery 618, preferably with a relatively low voltage, for example 3 volts, for compatibility with typical portable consumer electronic devices. A switch mode power supply unit 614 provides a power supply on line 616 to the column drivers, typically between 5 volts and 10 volts or a polymer OLED display, but up to 30 volts for a so-called small molecule based display OLED display. Power supply 614 also provides a power-on-reset output signal asserted when power is applied to the circuit.

Figure 7A:
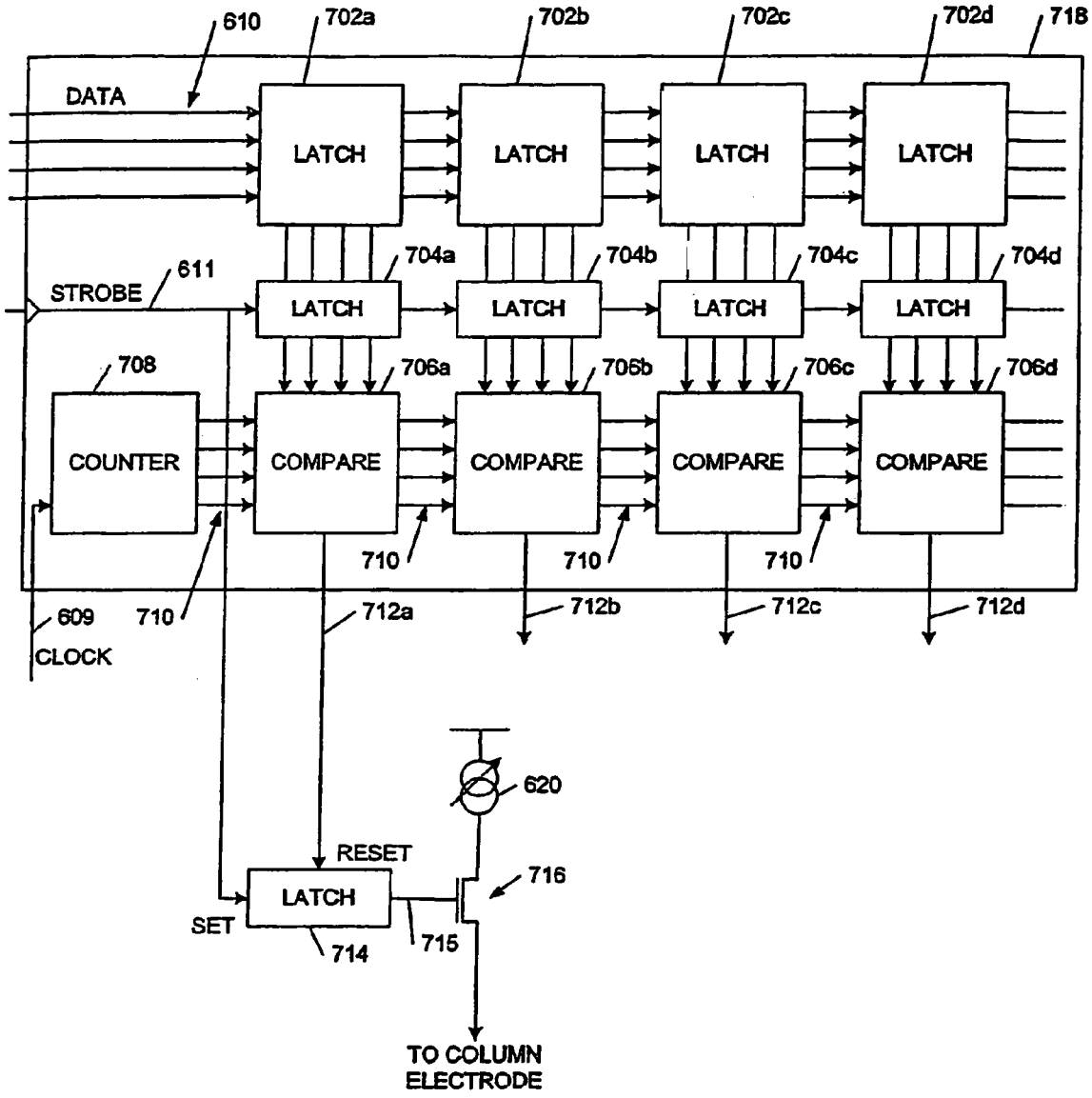
FIGS. 7*a* and 7*b* show details of column drive circuitry for the display driver of FIG. 6 for generating a conventional PWM drive waveform and a drive waveform according to an embodiment of present invention respectively.

FIG. 7*a* shows a column driver 700 suitable for producing a conventional pulse with modulated (PWM) current drive waveform. Input pixel brightness level data to the driver is provided on data bus 610, here shown comprising four lines (for clarity) but in practice generally comprising eight or more lines. Data is provided for each row of the display in turn, and for each row data is provided serially to the driver for each column of the display. Thus row zero data for all the columns of the display is first input serially to the column driver 700, then row one data for all the columns is input serially, and so forth. A pair of latches 702, 704 is provided for each column to store the pixel brightness data, and a compare circuit 706 is used to generate the PWM waveform. One pair of latches and one compare circuit is provided for each column, although for clarity in FIG. 7*a* only four pairs of latches and four compare circuits are shown.

To provide pixel brightness data for a row of pixels, data input on bus 610 is successively clocked through latches 702*a, b, c, d*, for example by a clock line from display drive logic 606 of FIG. 6 (not shown), these latches in effect acting as a shift register. The second set of latches 704*a* b, c, d latches the outputs of each of latches 702*a, b, c, d* respectively so that data for a next line (row) can be clocked into the driver whilst data for a current line is being processed. Latches 704*a, b, c, d* latch data for a row of the display in response to a row select strobe signal on line 611. A counter 708 counts up (in this embodiment) in response to a clock signal on line 609 and provides a parallel count data output 710 to each of compare circuits 706*a, b, c, d*. Each of the compare circuits 706*a, b, c, d* compares the counter output 710 with the pixel brightness data from the latch 704*a, b, c, d* to which it is connected, and provides a match output signal on a respective output line 712*a, b, c, d* when the two inputs are equal.

The output of each comparator is further processed by a latch 714 and an FET switch 716, of which only one instance is shown for clarity. Latch 714 has a Set input coupled to strobe line 611 and a Reset input coupled to comparator output 712, to thereby set and reset latch output 715. Latch output 715 controls FET switch 716 to switch a constant current drive 620 to a column electrode of display 302 in accordance with a PWM waveform. Current source 620 may be shared between a plurality of columns but preferably one current source is provided for each column.

Some or all of the elements of FIG. 7*a* may be provided within an integrated circuit. For example, it is convenient to provide the elements within line 718 within an integrated circuit; this IC may optionally further include latch 714 and/or FET 716. In embodiments the current drive 620 may be provided separately for increased flexibility.

In operation column drive data for a row of display 302 is first clocked along latches 702, and then stored in latches 704 in synchronism with the row select strobe. Counter 708 counts in a loop in synchronism with the row select strobe. The count begins at zero, (optionally the counter may be reset by the row select strobe line) and counts up to a maximum value corresponding to a data value for maximum brightness of a pixel, before looping back to zero in synchronism with the next row select strobe. When the row select strobe line 611 is asserted for a row, each column latch 714 is set (unless the output is to remain at zero when it is simultaneously reset by line 712) and transistor 716 is turned on to drive the column at a predetermined current drive level. Counter 708 counts up and, for each comparator, when the counter reaches a count corresponding to the latched pixel brightness data, output 712 is asserted to reset the latch, thus switching off transistor 716 and cutting off the current drive to the column. It can be seen that the larger the pixel brightness data value the longer the counter will take to reach this value, and hence the longer the duration for which the current drive is applied to a column electrode. Broadly speaking the column drive for each pixel of a row is turned on when the row is selected and then turned off for each pixel after a time interval corresponding to the pixel brightness level data. It will be recognised that in a variant of the circuit of FIG. 7*a* counter 708 could be arranged to count down rather than up.

Figure 7B:
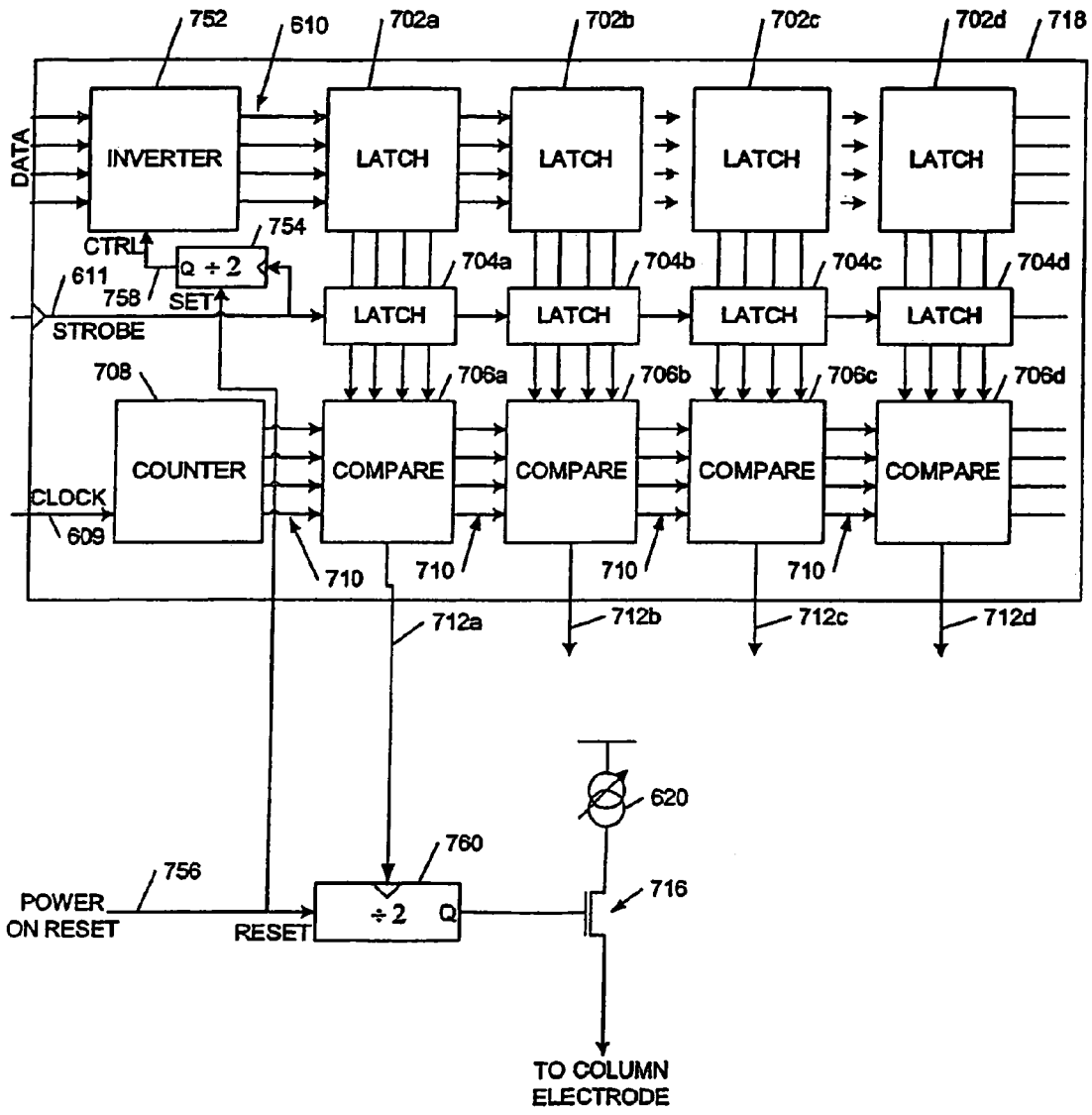

Referring now to FIG. 7*b*, this shows a modified column driver 750 in which like elements to those of FIG. 7*a* are indicated by like reference numerals. The main differences from the circuit of FIG. 7*a* comprise an inverter 752, a divide-by-two flip-flop 754 and a second flip-flop 760 to replace latch 714 of FIG. 7*a*.

Inverter 752 is connected between data input 610 and latches 702 and has a control input 758. When the control input is asserted inverter 752 inverts the data on line 610; when not asserted the data is not inverted. As described below, this allows the pixel brightness data clocked into latches 702 to be inverted for alternate rows. Preferably inverter 752 merely inverts the logic value of each line of databus 610 (1's complement inversion) although in other embodiments inverter 752 may implement a two's complement inversion.

Divide-by-two circuit 754 has a clock input coupled to row strobe 611, an output coupled to inverter control line 758, and a Set input coupled to a power on reset line 756 for the circuit. Power-on-reset line 756 provides a signal which is asserted when power is first applied to the circuit and is used to set divide-by-two 754 into a known initial state, in one embodiment asserting line 758 to place inverter 752 in complement or invert mode. Power on reset signal 756 may be provided in a conventional manner, for example, from power supply 614.

It can be seen that inverter 752 and divide-by-two 754 operate to invert the pixel data for every other row of the display, beginning by inverting the first row (row zero, using the above terminology). Counter 708 counts in only one direction, (as described above, up) and the effect of this is that the match signal output from comparators 706 will occur at a time-inverted position for alternate rows of the display, that is for those rows for which the pixel brightness data has been inverted.

The output 712 from a comparator 706 is used to generate a modified PWM waveform, by coupling this output to a clock input of a divide-by-two circuit 760 such as a T flip-flop. The divide-by-two circuit 760 has an output which controls transistor 716, and hence the timing of the current drive from constant current generator 620 to a column electrode of the display. The divide-by-two circuit also has a reset input coupled to the power-on reset line 756 so that it begins in a predefined state, in this example in a zero level or 'off' state.

Figure 8A:
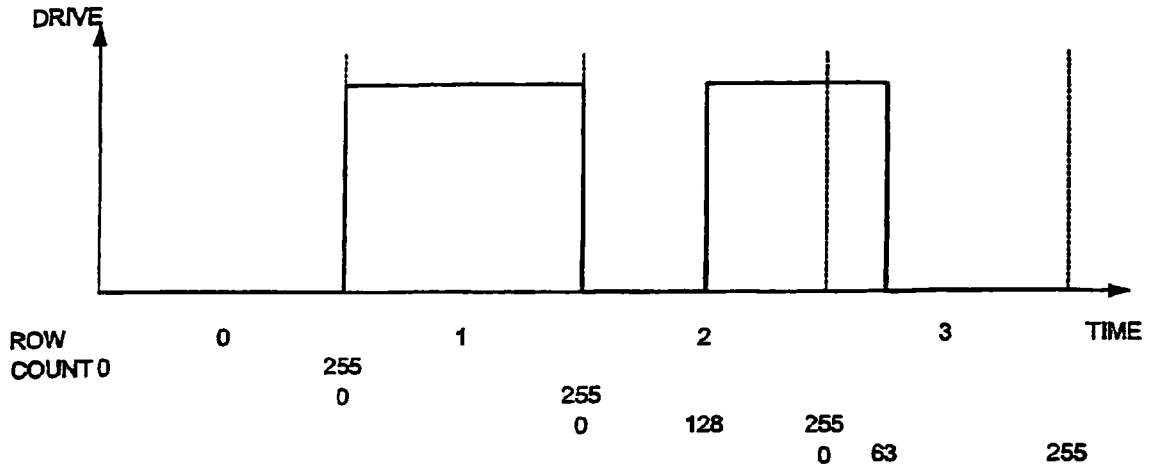
FIGS. 8*a* and 8*b* show examples of column drive waveforms according to embodiments of the present invention.
Figure 8B:
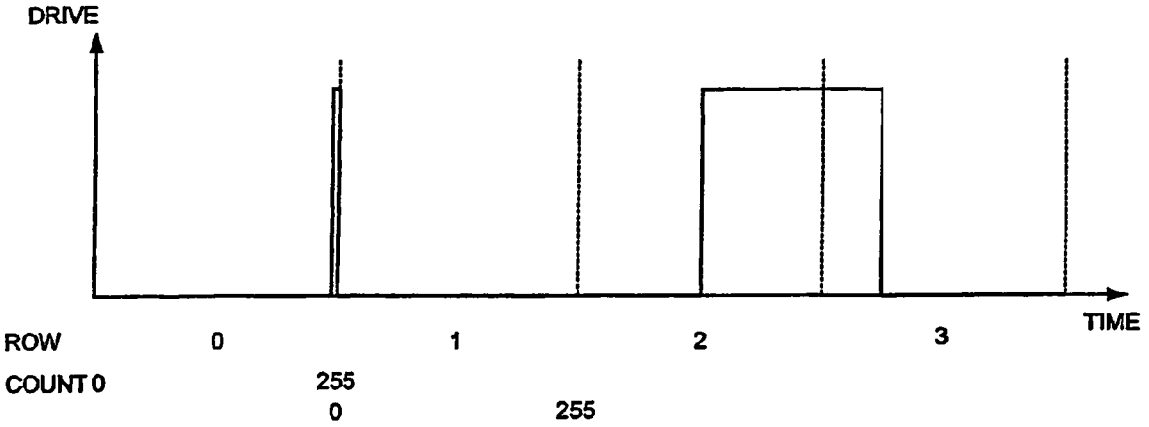

The operation of the arrangement of FIG. 7*b* will now be described with reference to the waveforms of FIGS. 8*a* and 8*b*, which show example current drive waveforms on column electrode drive line 720. More particularly, FIGS. 8*a* and 8*b* show drive waveforms corresponding to the pixel brightness data of Examples 1 and 2 given in Table 1 below accompanied by count values of counter 708.

TABLE 1

| Row | Example 1 | Example 2 |
|---|---|---|
| | Pixel Brightness Data on bus 610 | |
| 0 | 0000 0000 | 0000 0000 |
| 1 | 1111 1111 | 0000 0000 |
| 2 | 0111 1111 | 0111 1111 |
| 3 | 0011 1111 | 0011 1111 |
| | Storage latch 704 | |
| 0 | 1111 1111 | 1111 1111 |
| 1 | 1111 1111 | 0000 0000 |
| 2 | 1000 0000 | 1000 0000 |
| 3 | 0011 1111 | 0011 1111 |
| | Count for flip-flop 760 state change | |
| 0 | 255 | 255 |
| 1 | 255 | 0 |
| 2 | 128 | 128 |
| 3 | 63 | 63 |

In table 1 the first block shows pixel brightness data on data bus 610 for four successive rows (rows zero, one, two, three)

of one column of a display. The second block of data shows data values output from a storage latch 704, and the third block of data shows count values of counter 708 for which divide-by-two flip-flop 760 changes state, that is count values for which output 712 of a comparator 706 is asserted. The pixel brightness data for the two examples is the same except for row one, which in example 1 has a fully on pixel and in example 2 has a fully off pixel.

Referring to example 1 of table 1 and to FIG. 8*a*, the circuit begins at row zero with divide-by-two 760 reset, so that the waveform of FIG. 8*a* begins at zero, and with divide-by-two 754 set, so that the data is inverted. Thus for row zero the all-zeros input data is inverted to an all-ones output from the storage latch. The counter must therefore count to 255 before divide-by-two 760 changes state, and since 255 is the maximum count, in this example the first transition occurs at the boundary between row zero and row one (see FIG. 8*a*). The row one data is not inverted and thus the output of the storage latch is the same as the input data, and again the count must reach 255 before flip-flop 760 changes state giving a second transition. For row two, the output of the storage latch is inverted once again and the flip-flop 760 changes state at a count of 128, 1000 0000 in binary (see also FIG. 8*a*). After the counter has reached a value of 128 it continues to 255 at which point it resets to zero and counts up again to 63. At the point at which the counter loops back to zero, data for row three (63) is loaded into latch 704. Thus, row three is not inverted and thus the counter counts to 63 before flip-flop 760 again changes state, switching off the column drive. It can be seen from FIG. 8*a*, from inspection of the waveform for rows 2 and 3, that there is no transition at the change-over from one row to the next.

In the second example the data for row one is all zeros, and this is not inverted, so that the flip-flop 760 immediately changes state when row one is selected. However, it will be appreciated from the description of example 1 (which has the same row zero data as for example 2) that there is a transition at the end of row zero that is at a count of 255. This results in the waveform of FIG. 8*b*, in which a brief spike 802 is seen at the end of row zero. The width of this spike is exaggerated in FIG. 8*b* and in practice the spike will generally be very short, for example less than one nanosecond. Thus it is unlikely to be perceptible or to contribute significantly to the power consumption of the display (particularly as it only occurs under the rare circumstances shown in example (2). Nonetheless this spike may be removed using the circuit shown in FIG. 9.

Figure 9:
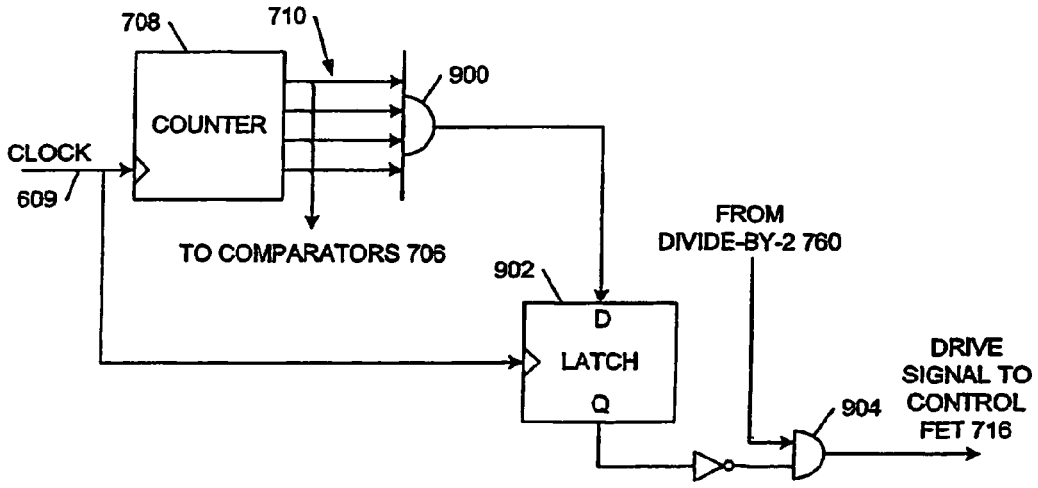
FIG. 9 shows a glitch suppression arrangement for the circuit of FIG. 7*b;*

In FIG. 9 an AND gate 900 is connected to the outputs of counter 708 to identify the all-1's condition causing the glitch in FIG. 8*b*. The output from AND gate 900 provides the data input D for a latch 902, which is clocked by the counter clock 609. The inverted output of latch 902 is then gated using an AND gate 904 with the output of divide-by-two 760 to remove the glitch, the output of gate 904 providing the control signal for FET switch 716.

Figure 10A:
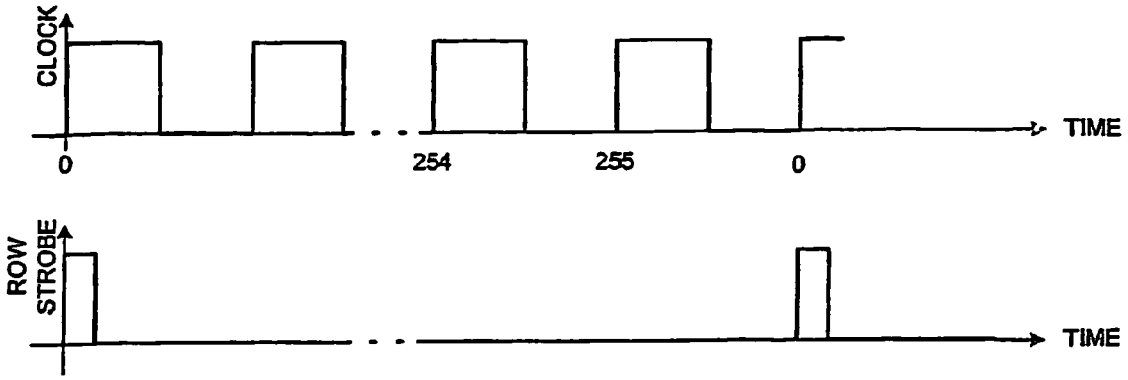
FIGS. 10*a* and 10*b* show relative timings of a clock signal and row select strobe for arrangements of the circuit of FIG. 7*b*.

FIG. 10*a* illustrates the relative timing of the clock signal on line 609 and the row strobe on line 611; the figures under the clock signal waveform represent the count of counter 708. In one embodiment the leading edge of the row strobe is substantially coincident with the clock leading edge and each count of the counter 708 has substantially the same duration. However, where the circuit of FIG. 9 is used to suppress glitches one part in 255 of the greyscale is effectively lost with the counting scheme of FIG. 10*a* and a clock signal as shown in FIG. 10*b* is therefore preferred.

Figure 10B:
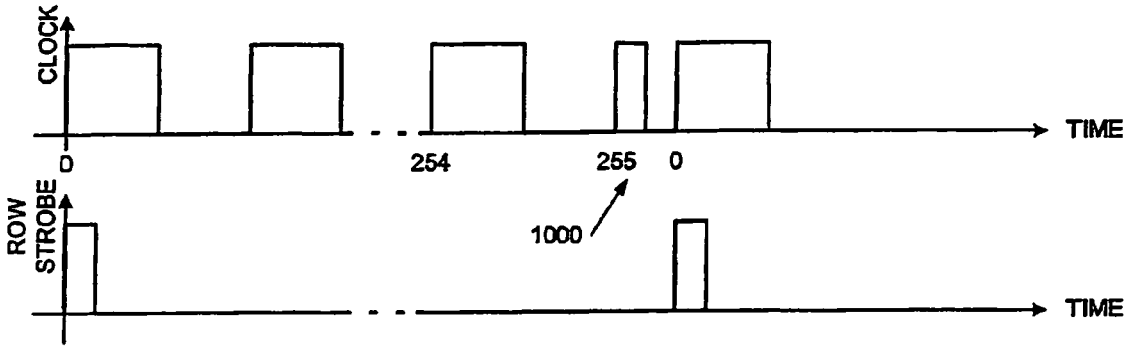

In FIG. 10*b* a regular clock is provided for all the counts of counter 708 except for the last, which is gated out to suppress glitches. This final clock cycle 1000 is preferably of a reduced duration in order to increase the pixel brightness dynamic range. The final clock cycle 1000, corresponding to count 255 in this 8-bit example, is preferably as short as possible given the practicalities of the technology. The final clock cycle may be shortened, for example by generating the clock signal by dividing down from a high frequency clock and resetting the clock divider on the final count.

Figure 11:
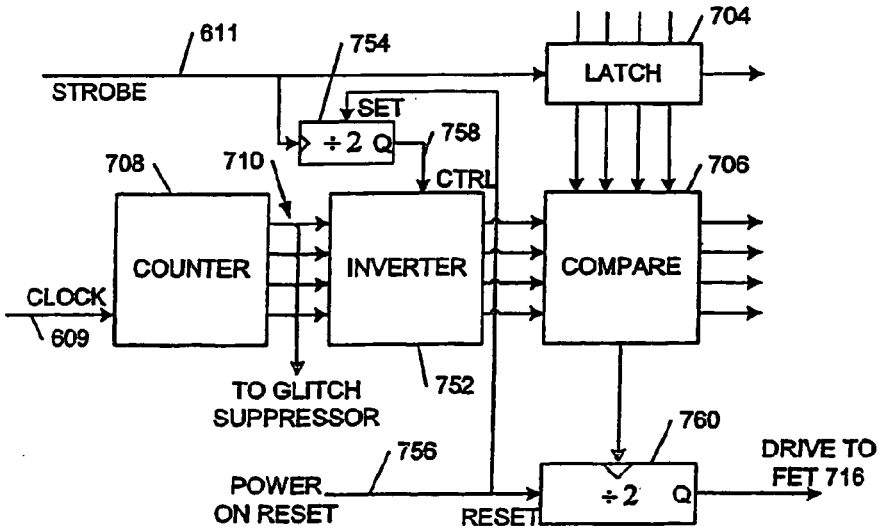
FIG. 11 shows a portion of the column driver of FIG. 7 illustrating a variant of the circuit.

FIG. 11 shows a portion of a variant of the column driver circuitry of FIG. 7*b*. In this variant inverter 752 is coupled to the output 712 of counter 708 (rather than to data bus 610) and the input data 610 is provided without inversion to latches 702. Divide-by-two 754 controls inverter 752 as previously described with reference to FIG. 7*b*, and the remainder of the circuitry (not shown in FIG. 11) also corresponds to FIG. 7*b*. It will be appreciated that from the point of view of comparator 706 either the pixel brightness data or the counter output may be inverted every alternate line, FIG. 7*b* illustrating the former and FIG. 11 the later variant.

The above-described circuits are particularly suitable for OLED-based passive matrix displays. This is because the electrode structure of an OLED display typically comprises row and column electrodes which overlap over a relatively large area (dependent upon the pixel size), but which have a relatively small separation, typically of the order of 0.1 micrometers. This results in a device with a relatively high intrinsic capacitance and this capacitance has a significant effect on power consumption.

Applications of embodiments of the invention are not restricted to passive matrix displays with a regular grid of electrodes but may be applied to passive matrix displays with other patterns of pixels such as seven segment or multi-segment displays which are addressed using one (or more) common electrode(s) (anode(s)) and a plurality of second electrodes (cathodes).

The skilled person will recognise that many variants on the above-described embodiments are possible. It will therefore be understood that the invention is not limited to the described embodiments but encompasses modifications apparent to those skilled in the art within the spirit and scope of the appended claims.

The invention claimed is:

1. A driver for a passive electro-optic display, the display having a plurality of display elements addressed by a common first electrode and a plurality of second electrodes, the display driver being configured to successively select each of said second electrodes in turn and to provide a variable pulse length drive to said first electrode during a period when a said second electrode is selected to provide a corresponding variable level display from each of said display elements, the driver comprising:

a data input to receive drive level data for each of said display elements;

an electrode selection input to receive a second electrode selection signal for determining said period when a said second electrode is selected to address a corresponding display element;

a drive output for driving said first electrode with a pulse having a length determined by said drive level data; and a pulse generator coupled to said data input, to said electrode selection input and to said drive output, said pulse generator being configured to generate a pulsed drive signal for said drive output responsive to said drive level data and to said second electrode selection signal, said pulsed drive signal having on states, and off states and transitions therebetween; and wherein said pulsed drive signal for driving successively selected second electrodes remains in one of a said on state and a said off state during selection of a successive second electrode and has a transition during said period when a said second electrode is selected.

2. A driver as claimed in claim 1 wherein an addressed one of said display elements is on during said on state of said pulsed drive signal and off during said off state of said pulsed drive signal, and wherein during each said period when a said second electrode is selected the duration of said on state is dependent upon said drive level data, whereby the display level of a said display element is determined.

3. A driver as claimed in claim 1 wherein said pulse generator comprises a counter configured to count responsive to a clock signal, and a comparator to compare an output of said counter with said drive level data for a display element addressed by a selected second electrode.

4. A driver as claimed in claim 3 further comprising an inverter coupled to said electrode selection input to invert one of said counter output and said drive level data for alternate ones of said successively selected second electrodes.

5. A driver as claimed in claim 3 further comprising gating means to suppress a said drive signal transition when said drive level data corresponds to an end value of said count.

6. A driver as claimed in claim 1 wherein said display comprises a passive matrix electroluminescent display, and wherein said first electrode comprises a column electrode of said matrix and said second electrodes comprise row electrodes of said matrix.

7. A driver as claimed in claim 1 wherein said drive output is configured to provide a substantially constant current drive to said display during a said on state of said drive signal.

8. A driver as claimed in claim 1 wherein said display elements comprise organic light emitting diodes.

9. A display driver for a passive matrix organo-electroluminescent display, the display having a plurality of row and column electrodes for addressing elements of the display, the driver being configured to successively select row electrodes of said display and to drive a said column electrode with successive pulse width modulated drive signals to drive a display element in each selected row to a brightness determined by a said drive signal; and wherein a said pulse width modulated drive signal has an on portion and an off portion, and wherein said driver is further configured to drive said column electrode for successive pairs of rows such that an off portion of a said pulse width modulated drive signal for a first selected row of a said pair followed by an on portion of said pulse width modulated drive signal for said first selected row is followed by an on portion of said pulse width modulated drive signal for a second selected row of said pair followed by an off portion of said pulse width modulated drive signal for said second selected row of said pair.

10. A method of driving a passive electro-optic display using a pulse width modulated drive signal, the display having at least one first electrode and a plurality of second electrodes for driving elements of the display, a selected display element being driven by selecting one of said second electrodes and applying said pulse width modulated drive signal across said first electrode and said selected second electrode, the method comprising:

selecting a first of said second electrodes to select a first said display element;

driving a first pulse width modulated signal across said first electrode and said first selected second electrode in accordance with a desired brightness of said first selected display element;

selecting a second of said second electrodes to select a second of said display elements; and driving a second pulse width modulated signal across said first electrode and said second selected second electrode in accordance with a desired brightness of said second selected display element; and wherein said first and second pulse width modulated signals each comprise a first portion followed by a second portion, one of said first and second portions comprising a on state of said signal, the other of said portions comprising an off state of said signal; and wherein said second portion of said first pulse width modulated signal and said first portion of said second pulse width modulated signal have the substantially same said state.

11. A method as claimed in claim 10 wherein said display comprises a passive matrix electro-optic display, and wherein said second electrodes comprise row electrodes of said display, the method further comprising successively selecting pairs of said row electrodes for selecting and driving as said first and second electrodes.

12. A method as claimed in claim 10 wherein said display comprises an organic electroluminescent display.

13. A method as claimed in claim 10 wherein said driving comprises driving using a pulse width modulated substantially constant current drive.

14. A method of driving a passive electro-optic display using a pulse width modulated drive signal, the display having at least one first electrode and a plurality of second electrodes for driving elements of the display, a selected display element being driven by selecting one of said second electrodes and applying said pulse width modulated drive signal across said first electrode and said selected second electrode, the method comprising:

selecting a first of said second electrodes to select a first said display element;

driving a first pulse width modulated signal across said first electrode and said first selected second electrode in accordance with a desired brightness of said first selected display element;

selecting a second of said second electrodes to select a second of said display elements; and driving a second pulse width modulated signal across said first electrode and said second selected second electrode in accordance with a desired brightness of said second selected display element; and wherein said second pulse width modulated signal is time reversed with respect to said first pulse modulated signal.

15. A computer readable medium storing a computer program to, when running, implement the method of claim 14.

16. A display driver controller for controlling a display driver for a passive electro-optic display using a pulse width modulated drive signal, the display having at least one first electrode and a plurality of second electrodes for driving elements of the display, a selected display element being driven by selecting one of said second electrodes and applying said pulse width modulated drive signal across said first electrode and said selected second electrode, the display driver controller comprising:

means for selecting a first of said second electrodes to select a first said display elements;

means for driving a first pulse width modulated signal across said first electrode and said first selected second electrode in accordance with a desire brightness of said first selected display element;

means for selecting a second of said second electrodes to select a second of said display elements; and means for driving a second pulse width modulated signal across said first electrode and said second electrode in accordance with a desired brightness of said second selected display element; and wherein said first and second pulse width modulated signals each comprise a first portion followed by a second portion, one of said first and second portions comprising a on state of said signal, the other of said portions comprising an off state of said signal; and wherein said second portion of said first pulse width modulated signal and said first portion of said second pulse width modulated signal have the substantially same said state.

17. A computer readable medium storing a computer program to, when running, implement the method of claim 9.

* * * * *

UNITED STATES PATENT AND TRADEMARK OFFICE

CERTIFICATE OF CORRECTION

PATENT NO. : 7,738,001 B2
APPLICATION NO. : 10/555335
DATED : June 15, 2010
INVENTOR(S) : Paul R. Routley et al.

It is certified that error appears in the above-identified patent and that said Letters Patent is hereby corrected as shown below:

In the Specification:

At Column 7, line 10, “a it selected” should be -- a first selected --;

At Column 7, line 10, “an,” should be -- an --.

Signed and Sealed this
Fifteenth Day of February, 2011

David J. Kappos

David J. Kappos
*Director of the United States Patent and Trademark Office*